US010583653B2

(12) United States Patent
Liu et al.

(10) Patent No.: US 10,583,653 B2
(45) Date of Patent: Mar. 10, 2020

(54) INKJET HEAD DEVICE FOR INKJET PRINTERS

(71) Applicant: LEAD TECH (ZHUHAI) ELECTRONIC CO., LTD., Zhuhai, Guangdong (CN)

(72) Inventors: Jinsong Liu, Guangdong (CN); Jingbiao Chen, Guangdong (CN); Guozheng Fu, Guangdong (CN); Yuandong He, Guangdong (CN); Ke He, Guangdong (CN)

(73) Assignee: LEAD TECH (ZHUHAI) ELECTRONIC CO., LTD., Zhuhai (CN)

( * ) Notice: Subject to any disclaimer, the term of this patent is extended or adjusted under 35 U.S.C. 154(b) by 0 days.

(21) Appl. No.: 16/198,868

(22) Filed: Nov. 22, 2018

(65) Prior Publication Data

US 2019/0224970 A1 Jul. 25, 2019

Related U.S. Application Data

(63) Continuation of application No. PCT/CN2018/084614, filed on Apr. 26, 2018.

(30) Foreign Application Priority Data

Jan. 23, 2018 (CN) ..... 2018 2 0115794 U
Jan. 23, 2018 (CN) ..... 2018 2 0115823 U

(51) Int. Cl.
*B41J 2/14* (2006.01)
*B41J 2/05* (2006.01)
(Continued)

(52) U.S. Cl.
CPC ..... *B41J 2/14024* (2013.01); *B41J 2/02* (2013.01); *B41J 2/05* (2013.01); *B41J 2/1433* (2013.01);
(Continued)

(58) Field of Classification Search
CPC ..... B41J 2/14024; B41J 2/05; B41J 2/1433; B41J 2002/0055; B41J 2/02; B41J 2/175
See application file for complete search history.

(56) References Cited

U.S. PATENT DOCUMENTS 8,360,560 B2 * 1/2013 Omer ..... B41J 2/02 347/74
2017/0197406 A1 * 7/2017 Smith ..... B41J 2/175

FOREIGN PATENT DOCUMENTS

CN 203805495 * 1/2014 ..... B41J 2/14
CN 203805495 U 9/2014

OTHER PUBLICATIONS

International Search Report of PCT Patent Application No. PCT/CN2018/084614 dated Aug. 3, 2018.

* cited by examiner

*Primary Examiner* — Henok D Legesse

(57) ABSTRACT

The present disclosure provides an inkjet head device for inkjet printers, which includes a tubular base, a composite plate and an inkjet head assembly mounted on the composite plate; the composite plate includes a fiberglass plate and a plastic plate integrally connected to the fiberglass plate, the fiberglass plate is engaged with the open side of the base along an axial direction of the base, the plastic plate is located on a surface facing the base of the fiberglass plate. According to the inkjet head device for inkjet printers of the disclosure, the base plate is a composite plate formed by integrally connecting the fiberglass plate and the plastic plate, where the inkjet head assembly is mounted to form an integrated module, thus the disassembly, the assembly, or the maintenance are convenient.

15 Claims, 4 Drawing Sheets

(51) Int. Cl.

| | |
|---|---|
| ***B41J 2/02*** | (2006.01) |
| ***B41J 2/175*** | (2006.01) |
| *B41J 2/005* | (2006.01) |

(52) U.S. Cl.
CPC ..... *B41J 2/175* (2013.01); *B41J 2002/0055* (2013.01)

INKJET HEAD DEVICE FOR INKJET PRINTERS

CROSS REFERENCE TO RELATED APPLICATIONS

The present application is a Continuation Application of PCT Application No. PCT/CN2018/084614 filed on Apr. 26, 2018, which claims the benefit of Chinese Patent Application Nos. 201820115794.X and 201820115823.2 filed on Jan. 23, 2018. All the above are hereby incorporated by reference.

TECHNICAL FIELD

The present disclosure relates to the technical field of inkjet printing, and more particularly, to an inkjet head device for inkjet printers.

BACKGROUND

Printing required patterns or marks on irregular surfaces is achieved by printers utilizing a non-contact automatic inkjet printing technology. The non-contact automatic inkjet printing technology is characterized in that an inkjet head device is applied in an electronic control mode to print required patterns or marks such as the production date, the batch number, the shelf life, etc., on irregular product packaging surfaces, which may be synchronously operated with the production line. The ink adopted in the inkjet printing technology has a certain conductivity so as to meet the electronic control requirements, and has relatively good adhesion so as to be well adhered to the product packaging surfaces.

In the existing market, components of the inkjet head device such as the heating blocks, the electromagnetic valves, the nozzle assemblies, the deflection plates etc., are separately disposed on different plates to form a plurality of modules to be mounted on the base, where the disassembly, assembly and maintenance of the components are troublesome.

SUMMARY OF THE DISCLOSURE

The present disclosure aims to provide an inkjet head device for inkjet printers, which is convenient to disassemble, assemble or maintain.

The disclosure discloses an inkjet head device for inkjet printers, wherein the inkjet head device comprises: a tubular base having an open side extending axially, a composite plate, and an inkjet head assembly mounted on the composite plate; wherein the composite plate comprises a fiberglass plate and a plastic plate integrally connected to the fiberglass plate; the fiberglass plate is engaged with the open side of the base along an axial direction of the base; the plastic plate is located on a surface facing the base of the fiberglass plate.

In an embodiment, the inkjet head assembly comprises an electromagnetic valve connecting mechanism, a nozzle assembly, a charging slot, a deflection assembly and a recovery mechanism, which are sequentially mounted on the composite plate;

the plastic plate is arranged on a surface of end of the fiberglass plate corresponding to the nozzle assembly, the charging slot, the deflection assembly and the recovery mechanism; the nozzle assembly, the charging slot, the deflection assembly and the recovery mechanism are locked on the plastic plate with a locking assembly extending through the fiberglass plate.

In an embodiment, the electromagnetic valve connecting mechanism comprises: at least one electromagnetic valve disposed on a surface facing away from the base of the fiberglass plate, and at least one heating member disposed on a surface facing the base of the fiberglass plate; wherein the electromagnetic valve is provided with a pin extending towards the direction of the fiberglass plate; a socket is embedded in the fiberglass plate and the heating member, the pin is inserted into the socket and is electrically connected to the socket.

In an embodiment, the electromagnetic valve connecting mechanism further comprises a fastening assembly disposed between the electromagnetic valve and the heating member.

In an embodiment, a flowing passage is arranged on the heating member for liquid to pass through; the flowing passage is communicated with the electromagnetic valve.

In an embodiment, the electromagnetic valve connecting mechanism comprises four electromagnetic valves, which are ink supply valve, cleaning valve, backflow valve and recovery valve respectively;

the flowing passage comprises an ink supply passage communicated with the ink supply valve, a cleaning passage communicated with the cleaning valve, and a backflow passage communicated with the backflow valve; wherein the cleaning passage, the cleaning valve, the backflow valve and the backflow passage are communicated in sequence to form a cleaning circuit.

In an embodiment, one end of the heating member is provided with three first inlets/outlets communicated with the ink supply passage, the cleaning passage and the backflow passage respectively; another end of the heating member is provided with two second inlets/outlets, wherein the ink supply valve and the cleaning valve are communicated with one second inlet/outlet, the backflow valve is connected with another second inlet/outlet.

In an embodiment, the electromagnetic valve connecting mechanism further comprises a first connecting base and a second connecting base, which protrude out of the surface facing away from the base of the fiberglass plate;

wherein the first connecting base corresponds to the first inlet/outlet and is arranged on one end of the heating member, the first connecting base is provided with three spaced first interfaces which are connected with the three first inlets/outlets respectively;

the second connecting base corresponds to the second inlet/outlet and is arranged on another end of the heating member, the second connecting base is provided with two spaced second interfaces which are connected with the two second inlets/outlets respectively.

In an embodiment, a recovery pipe is arranged on a side facing the base of the composite plate, the recovery pipe is connected to the recovery mechanism and the recovery valve.

In an embodiment, the nozzle assembly comprises an adjusting bracket, a nozzle fixed on the adjusting bracket, and an eccentric adjusting assembly arranged between the adjusting bracket and the fiberglass plate to drive the adjusting bracket to horizontally swing on the fiberglass plate;

the eccentric adjusting assembly comprises an eccentric member, a waist-shaped slot which corresponds to the eccentric member and is arranged on the fiberglass plate, and an adjusting center pillar member; wherein a lower end of the eccentric member is arranged within the waist-shaped slot, an upper end of the eccentric member extends through the adjusting bracket; the adjusting center pillar member is positioned on one side of the eccentric member, a non-cylindrical pillar part of the adjusting center pillar member is engaged with the fiberglass plate, a cylindrical top of the adjusting center pillar member extends through the adjusting bracket.

In an embodiment, the adjusting bracket comprises a substrate, and a supporting part protruding out of the substrate; wherein the nozzle is fixed on the supporting part and is in parallel with the substrate; a first through hole and a second through hole are arranged on one side of the substrate, wherein the upper side of the eccentric member is inserted within the first through hole, the cylindrical top of the adjusting center pillar member is inserted within the second through hole.

In an embodiment, the nozzle assembly further comprises a vertical adjusting assembly arranged between the adjusting bracket and the fiberglass plate, to adjust the height of the adjusting bracket on the fiberglass plate;

the vertical adjusting assembly and the eccentric adjusting assembly are arranged on the adjusting bracket and are adjacent to two opposite sides of the adjusting bracket respectively.

In an embodiment, the vertical adjusting assembly comprises a set screw, and a screw hole arranged on the adjusting bracket; the set screw is engaged into the screw hole, the bottom of the set screw is abutted against the fiberglass plate.

In an embodiment, the nozzle assembly further comprises a first fixing assembly and a second fixing assembly, which are arranged on the adjusting bracket and are adjacent to another two opposite sides of the adjusting bracket respectively, so as to lock the adjusting bracket on the fiberglass plate.

In an embodiment, the first fixing assembly comprises a first screw, a first waist-shaped hole which corresponds to the first screw and is arranged on the adjusting bracket, and a first fixing hole which is communicated with the first waist-shaped hole and is arranged on the fiberglass plate; the first screw extends through the first waist-shaped hole to be screwed into the first fixing hole;

a length direction of the first waist-shaped hole is parallel to a horizontal swinging direction of the adjusting bracket.

In an embodiment, the second fixing assembly comprises a second screw, a second waist-shaped hole which corresponds to the second screw and is arranged on the adjusting bracket, and a second fixing hole which is communicated with the second waist-shaped hole and is arranged on the fiberglass plate; the second screw extends through the second waist-shaped hole to be screwed into the second fixing hole.

In an embodiment, one end of the base is provided with a chamber which is connected with the delivery pipe of the inkjet printer, the electromagnetic valve connecting mechanism is arranged on the composite plate and is close to the chamber.

According to the inkjet head device for inkjet printers of the disclosure, the base plate is a composite plate formed by integrally connecting the fiberglass plate and the plastic plate, where the inkjet head assembly is mounted to form an integrated module, thus the disassembly, the assembly or the maintenance are convenient. The inkjet head assembly is basically arranged on the fiberglass plate, thus a smooth surface of the fiberglass plate can be utilized to prevent from being contaminated by ink, and to be convenient to clean; the plastic plate is arranged on a back surface of the fiberglass plate, such that the inkjet head assembly may be fastened on the composite plate conveniently.

BRIEF DESCRIPTION OF THE DRAWINGS

The present disclosure will be described in more detail with reference to the accompany drawings and the embodiments, wherein the drawings.

PREFERRED EMBODIMENTS

For clearly understanding technical features, purpose, and effect of the present disclosure, embodiments are given in detail hereinafter with reference to the accompanying drawings.

Figure 1:
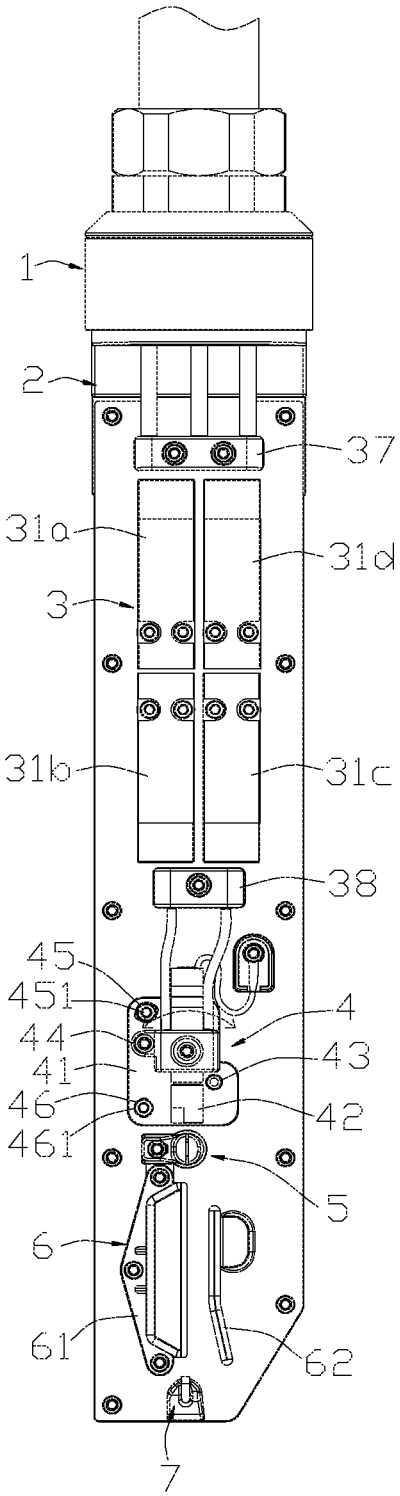
FIG. 1 is a schematic view of an inkjet head device in an embodiment of the present disclosure.
Figure 2:
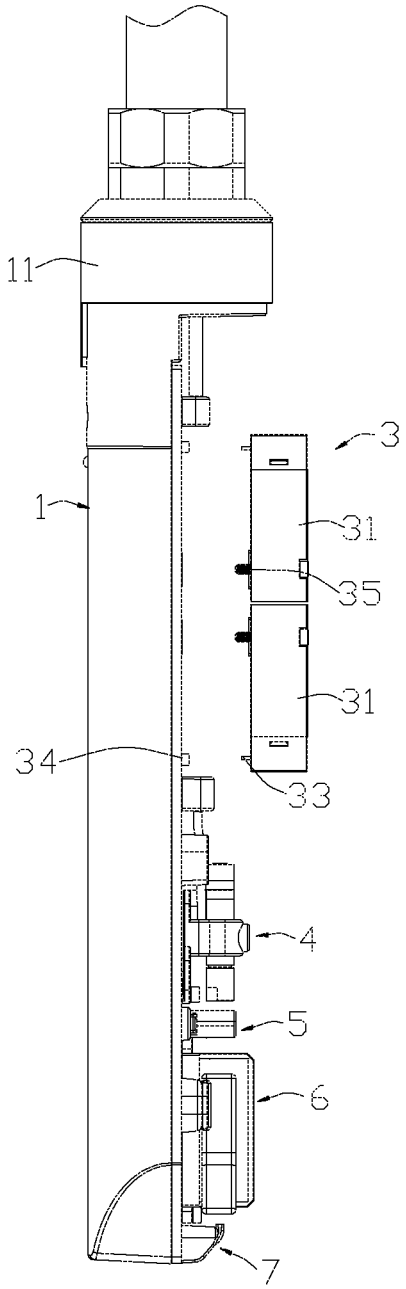
FIG. 2 is a side view of the inkjet head device in FIG. 1.
Figure 3:
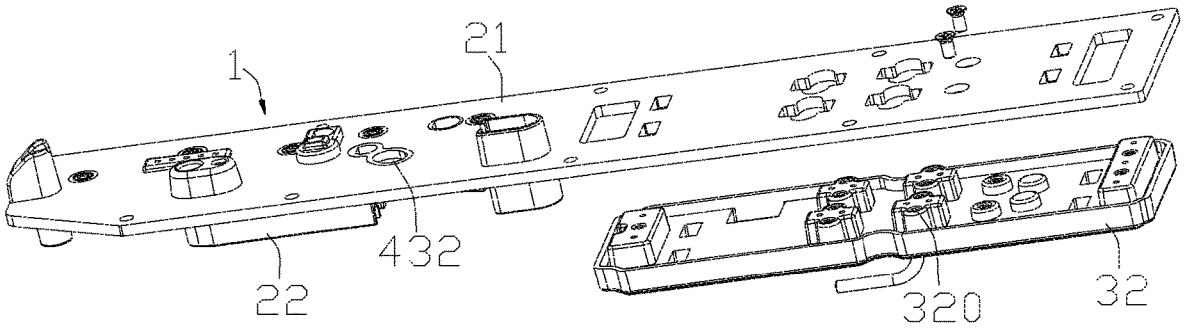
FIG. 3 is an exploded schematic view showing a composite plate and a heating member in the inkjet head device in FIG. 1.

Referring to FIGS. 1-3, an inkjet head device for an inkjet printer in an embodiment of the present disclosure includes a base 1, a composite plate 2 and an inkjet head assembly. The inkjet head assembly is mounted on the composite plate 2 to form an integrated module, thereby the disassembly, the assembly and the maintenance of the inkjet head assembly are convenient. The base 1 is a tubular base having an open side extending axially. The composite plate 2 includes a fiberglass plate 21 and a plastic plate 22 integrally connected to the fiberglass plate 21. The fiberglass plate 21 is engaged with the open side of the base 1 along an axial direction of the base 1. The plastic plate 22 is located on a surface facing the base 1 of the fiberglass plate 21.

The fiberglass plate 21 and the plastic plate 22 may be integrally formed through integral injection molding. For example, when the plastic plate 22 is formed by injection molding, firstly placing the fiberglass plate 21 in a mold, then pouring materials to form the plastic plate 22. In the composite plate 2, the surface of the fiberglass plate 21 is smooth and is convenient to clean. The plastic plate 22 has a certain elasticity and strength, such that it may be fastened with the inkjet head assembly conveniently. Therefore, the inkjet head assembly can be fastened on the composite plate 2.

A number of connecting holes corresponding to the inkjet head assembly may be arranged on the fiberglass plate 21, such that a locking assembly can extend therethrough and be locked on the plastic plate 22, to lock the inkjet head assembly on the composite plate 2.

The inkjet head assembly includes an electromagnetic valve connecting mechanism 3, a nozzle assembly 4, a charging slot 5, a deflection assembly 6 and a recovery mechanism 7, which are sequentially mounted on the composite plate 2. One end of the base 1 is provided with a chamber 11 which is connected with the delivery pipe of the inkjet printer. The electromagnetic valve connecting mechanism 3 is arranged on the composite plate 2 and is adjacent to the chamber 11. The plastic plate 22 is arranged on a surface of one end of the fiberglass plate 21 corresponding to the nozzle assembly 4, the charging slot 5, the deflection assembly 6 and the recovery mechanism 7. The nozzle assembly 4, the charging slot 5, the deflection assembly 6 and the recovery mechanism 7 are locked on the plastic plate 22 via the locking assembly extending through the fiberglass plate 21.

In the inkjet head assembly, the electromagnetic valve connecting mechanism 3 is communicated with the nozzle assembly 4. The deflection assembly 6 includes a zero volt plate 61 and a high pressure deflection plate 62, which are oppositely arranged and spaced apart from each other. An ink drop passage is defined by the space between the zero volt plate 61 and a high pressure deflection plate 62. The nozzle assembly 2, the charging slot 5, the ink drop passage and the recovery port of the recovery mechanism 7 are aligned in a straight line. The electromagnetic valve connecting mechanism 3 heats the solution such as the ink, and the solution is conveyed to the nozzle assembly 2, the nozzle assembly 2 sprays out the solution in a droplet manner, the droplets deflect under the action of the deflection assembly 6 after passing through the charging slot 5 so as to be sprayed to the surface of the materials, and the non-deflected droplets enter the recovery mechanism 7 linearly.

Figure 4:
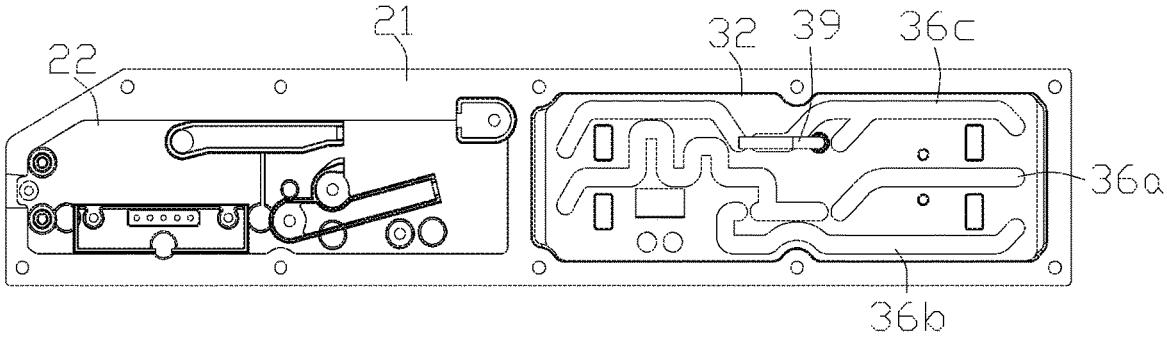
FIG. 4 is a schematic view of the combined structure of FIG. 3.

The electromagnetic valve connecting mechanism 3 includes at least one electromagnetic valve 31 and one heating member 32. The electromagnetic valve 31 is arranged on a surface facing away from the base 1 of the fiberglass plate 21, and the heating member 32 is arranged on a surface facing the base 1 of the fiberglass plate 21 (as shown in FIG. 4). The electromagnetic valve 31 is provided with a pin 33 extending towards the fiberglass plate 21, and a socket 34 is embedded in the fiberglass plate 21 and the heating member 32. The socket 34 may be electrically connected to a PCB of the inkjet printer via electrically conductive wires. The pin 33 is inserted into the socket 34 and is electrically connected to the socket 34, such that electromagnetic valve 31 and the circuit board are electrically connected, which makes the operation be convenient.

When combining the heating member 32 and the fiberglass plate 21, black glue may be applied on one side of the heating member 32 firstly, then attach the heating member 32 to a surface of the fiberglass plate 21 by the black glue, next lock the heating member 32 and the fiberglass plate 2 together with screws. The heating member 32 and the fiberglass plate 21 may be tightly attached through a gluing clamp, and then bake them in an oven, so that the heating member 32 and the fiberglass plate 21 can be tightly adhered together by hot melting the black glue.

The electromagnetic valve connecting mechanism 3 further includes a fastening assembly 35 disposed between the electromagnetic valve 31 and the heating member 32, so as to connect the electromagnetic valve 31 with the heating member 32, and to lock the electromagnetic valve 31 on the composite plate 2 tightly. As shown in FIG. 3, the heating member 32 is a heating plate structure corresponding to the coverage area of all the electromagnetic valves 31. The heating member 32 is provided with a fastening hole 320 corresponding to the fastening assembly 35, and the fiberglass plate 21 is provided with a hole communicated with the fastening hole, so that the fastening assembly 35 can be engaged within the fastening hole 320 by extending through the hole in the fiberglass plate 21.

Each electromagnetic valve 31 has two pins, which are corresponding to the positive and negative electrodes respectively.

As shown in FIGS. 1 and 4, the heating member 32 is provided with a flowing passage 36 for liquid to pass therethrough, where the flowing passage 36 is communicated with the electromagnetic valve 31. After the heating member 32 is electrified and heated, liquid (ink etc.) flowing in the flowing passage 36 can be heated, and the electromagnetic valve 31 is used to control the flow direction of the liquid, so as to output the corresponding liquid as needed.

In the present embodiments, the electromagnetic valve connecting mechanism 3 includes four electromagnetic valves 31, which are an ink supply valve 31*a*, a cleaning valve 31*b*, a backflow valve 31*c* and a recovery valve 31*d* respectively. The four electromagnetic valves 31 are averagely divided into two groups, and the two groups of electromagnetic valves 31 are symmetrically arranged on the fiberglass plate 21.

Correspondingly, the flowing passage 36 may include an ink supply passage 36*a* communicated with the ink supply valve 31*a*, a cleaning passage 36*b* communicated with the cleaning valve 31*b*, and a backflow passage 36*c* communicated with the backflow valve 31*c*. The cleaning passage 36*b*, the cleaning valve 31*b*, the backflow valve 31*c* and the backflow passage 36*c* are communicated in sequence to form a cleaning circuit.

One end of the heating member 32 is provided with three first inlets/outlets (not shown) communicated with the ink supply passage 36*a*, the cleaning passage 36*b* and the backflow passage 36*c* respectively. another end of the heating member 32 is provided with two second inlets/outlets (not shown), wherein the ink supply valve 31*a* and the cleaning valve 31*b* are communicated with one second inlet/outlet, the backflow valve 31*c* is communicated with another second inlet/outlet.

Furthermore, the electromagnetic valve connecting mechanism 3 further includes a first connecting base 37 and a second connecting base 38, which protrude out of a surface facing away from the base 1 of the fiberglass plate 21. The first connecting base 37 corresponds to the first inlet/outlet and is arranged on one end of the heating member 32. The first connecting base 37 is provided with three spaced first interfaces which are connected with the three first inlets/outlets respectively. The second connecting base 38 corresponds to the second inlet/outlet and is arranged on another end of the heating member 32. The second connecting base 38 is provided with two spaced second interfaces which are connected with the two second inlets/outlets respectively. The first connecting base 37 and the second connecting base 38 may be integrally connected to the heating member 32, and extend through the fiberglass plate 21 to protrude out of a surface of the fiberglass plate 21.

A recovery pipe 39 is arranged on a side facing the base 1 of the composite plate 2. The recovery pipe 39 is connected to the recovery mechanism 7 and the recovery valve 31*d*.

It can be understood that in the inkjet head device disclosed by the present disclosure, the specific structure of each part of the nozzle assembly 4, the charging slot 5, the deflection assembly 6 and the recovery mechanism 7 can be achieved by a prior art.

In the inkjet head device disclosed by the present disclosure, the nozzle assembly 4 may also be adjusted to achieve the adjustment of the nozzle assembly 4 in a horizontal angle and a vertical angle, so as to guarantee that the nozzle, the charging slot 5 and the recovery mechanism 7 are aligned in a straight line, and to achieve better recycling of the solution sprayed out of the nozzle. Therefore, the interior of the inkjet head device can be ensured to be clean.

Figure 5:
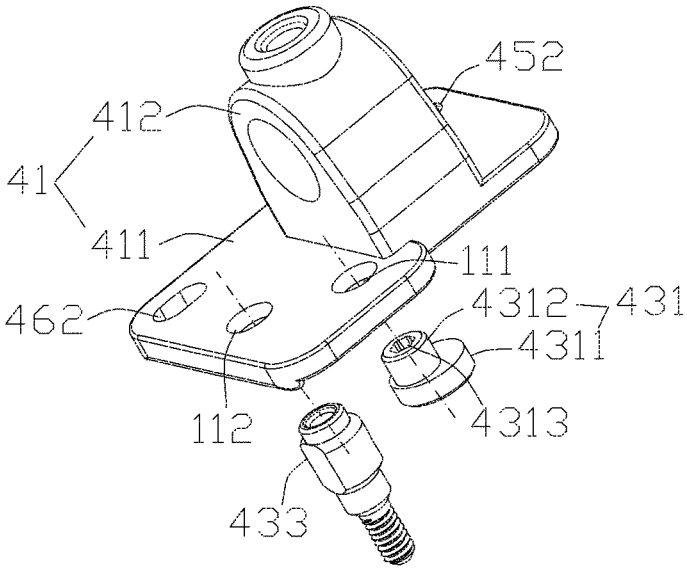
FIG. 5 is an exploded schematic view of a nozzle assembly in the inkjet head device shown in FIG. 1.

As shown in FIGS. 1 and 5, alternatively, the nozzle assembly 4 may include an adjusting bracket 41, a nozzle 42 and an eccentric adjusting assembly 43. The nozzle 42 is fixed on the adjusting bracket 41, and the adjusting bracket 41 is arranged on the fiberglass plate 21 as a supporting structure of the nozzle 42. The eccentric adjusting assembly 43 is arranged between the adjusting bracket 41 and the nozzle 42, to drive the adjusting bracket 41 to horizontally swing (as indicated by the dotted arrow in FIG. 1) on the fiberglass plate 21, so as to adjust the horizontal orientation of the nozzle 42, and to achieve a fine adjustment of the nozzle 42, and to align with the recovery mechanism 7 of the inkjet head device.

Figure 6:
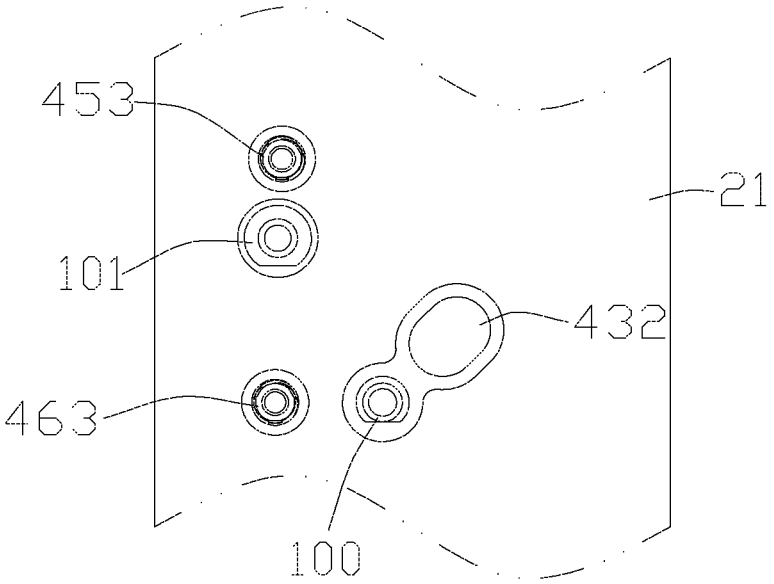
FIG. 6 is a partial schematic view of a fiberglass plate in the inkjet head device in FIG. 1.

Specifically, as shown in FIGS. 1, 5 and 6, the eccentric adjusting assembly 43 includes an eccentric member 431, a waist-shaped slot 432 which corresponds to the eccentric member 431 and is arranged on the fiberglass plate 21, and an adjusting center pillar member 433. A lower end of the eccentric member 431 is arranged within the waist-shaped slot 432, and an upper end of the eccentric member 431 extends through the adjusting bracket 41 and is movable. When the eccentric member 431 is driven to rotate, the movement of the lower end of the eccentric member 431 in the waist-shaped slot 432 drives the upper end of the eccentric member 431 and the adjusting bracket 41 to swing. The adjusting center pillar member 433 is located on one side of the eccentric member 431, and serves as a center fixed-point when the adjusting bracket 41 swings. A non-cylindrical pillar part of the adjusting center pillar member 433 is engaged with the fiberglass plate 21, such that the non-cylindrical pillar part and the fiberglass plate 21 will not rotate relative to each other. A cylindrical top of the adjusting center pillar member 433 extends through the adjusting bracket 41 and is movable.

As shown in FIG. 3, the plastic plate 22 is arranged on a side facing the base 1 of the fiberglass plate 21 and is staggered with the waist-shaped slot 43, such that a space is reserved for the installation of the eccentric adjusting assembly 43.

The adjusting bracket 41 may include a substrate 411 and a supporting part 412 protruding out of the substrate 411. The nozzle 42 is fixed on the supporting part 412 and is in parallel with the substrate 411. A first through hole 111 and a second through hole 112 are arranged on one side of the substrate 411. The upper end of the eccentric member 431 is inserted within the first through hole, and the cylindrical top of the adjusting center pillar member 433 is inserted within the second through hole 112. Wherein, the upper end of the eccentric member 431 is movably inserted within the first through hole 111, and the upper end of the eccentric member 431 can rotate circumferentially in the first through hole 111. The cylindrical top of the adjusting center pillar member 433 is movably inserted within the second through hole 112, and the cylindrical top of the adjusting center pillar member 433 can rotate circumferentially in the second through hole 112.

The eccentric member 431 further may include a cylindric base 4311 and a cylindric pillar 4312 axially and eccentrically connected to the cylindric base 4311. The cylindric base 4311 and the cylindric pillar 4312 are both cylindrical members, and the diameter of the cylindric base 4311 is larger than that of the cylindric pillar 4312. The cylindric pillar 4312 is integrally connected to the cylindric base 4311 and is adjacent to a periphery of the cylindric base 4311. Wherein, the cylindric base 4311 forms the lower end of the eccentric member 431, and the cylindric pillar 4312 forms the upper end of the eccentric member 431. The circumferential rotation of the eccentric member 431 drives the cylindric base 4311 to move in the waist-shaped slot 432, so as to drive the adjusting bracket 41 to horizontally swing relative to the fiberglass plate 21 by taking the adjusting center pillar member 433 as a center.

Additionally, the cylindric pillar 4312 is provided with a non-circular through hole 4313 such as a hexagon hole, for a rotation tool (such as an inner hexagon wrench) to be inserted therethrough to rotate the eccentric member 431.

The size of the waist-shaped slot 432 on the fiberglass plate 21 can be equivalent to that formed by overlapping the cylindric base 4311 of two eccentric members 431. When the cylindric base 4311 moves in the waist-shaped slot 432, an edge part of the cylindric base 4311 abuts against the inner walls of two ends of the waist-shaped slot 432, so as to achieve the back-and-forth swing of the adjusting bracket 41 on the fiberglass plate 21.

Corresponding to the adjusting center pillar member 433, the fiberglass plate 21 is provided with a hole 100 for the non-cylindrical pillar part of the adjusting center pillar member 433 to be accommodated therein, and the non-cylindrical pillar part of the adjusting center pillar member 433 cannot rotate in the hole 100.

Furthermore, as shown in FIG. 1, the nozzle assembly 4 also includes a vertical adjusting assembly 44 arranged between the adjusting bracket 41 and the fiberglass plate 21, to adjust the height of the adjusting bracket 41 on the fiberglass plate 21. The vertical adjusting assembly 44 and the eccentric adjusting assembly 43 are arranged on the adjusting bracket 41 and are adjacent to two opposite sides of the adjusting bracket 41 respectively.

Figure 7:
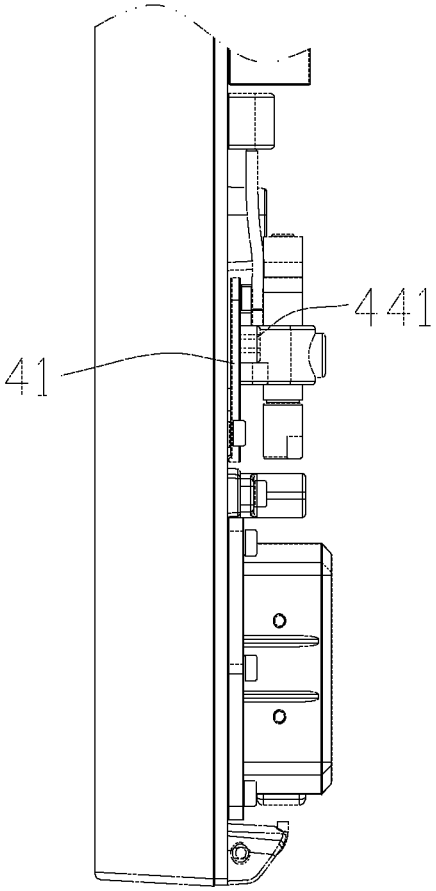
FIG. 7 is a side view of FIG. 1.

As shown in FIGS. 5 to 7, in the present embodiments, the vertical adjusting assembly 44 includes a set screw 441, and a screw hole (not shown) arranged on the adjusting bracket 41. The screw hole is mainly arranged on the substrate 411. The set screw 441 is screwed into the screw hole, and the bottom of the set screw 441 is abutted against the fiberglass plate 21. The fiberglass plate 21 can be provided with a position point 101 corresponding to the set screw 441. During adjustment, rotate the set screw 441, so as to drive the adjusting bracket 41 to rotate in a vertical direction relative to the fiberglass plate 21.

Furthermore, as shown in FIG. 1, the nozzle assembly 4 also includes a first fixing assembly 45 and a second fixing assembly 46, which are arranged on the adjusting bracket 41 and are adjacent to another two opposite sides of the adjusting bracket 41 respectively. The adjusting bracket 41 is locked on the fiberglass plate 21 through the first fixing assembly 45 and the second fixing assembly 46.

As shown in FIGS. 1, 5 and 6, in the present embodiments, the first fixing assembly 45 includes a first screw 451, a first waist-shaped hole 452 which corresponds to the first screw 451 and is arranged on the adjusting bracket 41, and a first fixing hole 453 which is communicated with the first waist-shaped hole 452 and is arranged on the fiberglass plate 21. The first screw 451 extends through the first waist-shaped hole 452 to be screwed into the first fixing hole 453, such that the adjusting bracket 41 can be locked on the fiberglass plate 21 tightly. A length direction of the first waist-shaped hole 452 is parallel to a horizontal swing direction of the adjusting bracket 41, so that after the horizontal swing of the adjusting bracket 41 is adjusted, the first screw 451 can extend through the corresponding position of the first waist-shaped hole 452 to be fastened in the first fixing hole 453.

The second fixing assembly 46 includes a second screw 461, a second waist-shaped hole 462 which corresponds to the second screw 461 and is arranged on the adjusting bracket 41, and a second fixing hole 463 which is communicated with the second waist-shaped hole 462 and is arranged on the fiberglass plate 21. The second screw 461 extends through the second waist-shaped hole 462 to be screwed into the second fixing hole 463, such that the adjusting bracket 41 can be locked on the fiberglass plate 21. A length direction of the second waist-shaped hole 462 can correspond to a vertical adjustment direction of the adjusting bracket 41, such that after the adjusting bracket 41 is vertically adjusted, the second screw 461 can extend through the corresponding position of the second waist-shaped hole 462 to be fastened in the second fixing hole 463.

The first waist-shaped hole 452 and the second waist-shaped hole 462 are specifically arranged on the substrate 411 of the adjusting bracket 41.

During the horizontal swing adjustment of the nozzle assembly 4, firstly unscrew the first fixing assembly 45 and the second fixing assembly 46, then rotate the eccentric member 431, which drives the adjusting bracket 41 to swing (micro swing) in the horizontal direction relative to the fiberglass plate 21, the swing direction is as shown by the dotted arrow in FIG. 1. After being adjusted to the required angle, fasten the first fixing assembly 45 and the second fixing assembly 46 tightly.

During the vertical adjustment of the nozzle assembly 4, firstly unscrew the first fixing assembly 45 and the second fixing assembly 46, then rotate the set screw 441, which drives the adjusting bracket 41 to move or rotate at one end in the vertical direction relative to the fiberglass plate 21. After being adjusted to the required position, fasten the first fixing assembly 45 and the second fixing assembly 46 tightly.

Furthermore, the inkjet head device in the present disclosure further includes a sleeve (not shown) having a closed end. The sleeve is sleeved on the outside of the base 1 along an axial direction of the base 1, so as to seal the inkjet head assembly. The electromagnetic valve connecting mechanism 3, the nozzle assembly 4, the charging slot 5, the deflection assembly 6, etc. can all be connected with the circuit board of the inkjet printer through conductive wires. The wires are accommodated between the base 1 and the composite plate 2, and can be led out from the end provided with the chamber 11 of the base 1, so as to be connected with the circuit board.

When the inkjet head device in the present disclosure works, ink conveyed from the liquid storage box sequentially passes through the chamber 11 and the first connecting base 37 to enter the ink supply passage 36*a*, then sequentially passes through the ink supply valve 31*a* and the second connecting base 38 to flow to the nozzle assembly 4. The nozzle assembly 4 spays out the ink in a connecting line in an ink drop manner. The ejected ink drops are charged and pass through the ink drop passage after passing through the charging slot 5, and then spray on the surface of the material according to the dot matrix format of the characters. The uncharged ink drops will not be deflected, and linearly enter the recovery mechanism 7 to be recycled.

When cleaning the inkjet head device, the cleaning solvent sequentially passes through the chamber 11 and the first connecting base 37 to enter the cleaning passage 36*b*, then sequentially passes through the cleaning valve 31*b* and the second connecting base 38 to enter the nozzle assembly 4, then flows out of the nozzle assembly 4, then sequentially enters the backflow valve 31*c* and the backflow passage 36*c*, finally pass through the first connecting base 37 to be discharged, so as to achieve the cleaning effect.

The contents described above are only preferred embodiments of the present disclosure, but the scope of the present disclosure is not limited to the embodiments. Any modifications or replacements of equivalent structures or equivalent processes made by using the specification and the drawings of the present disclosure, or any directly or indirectly application to other related technical fields, should be included in the protection scope of the present disclosure.

What is claimed is:

1. An inkjet head device for inkjet printers, wherein the inkjet head device comprises: a tubular base (1) having an open side extending axially, a composite plate (2), and an inkjet head assembly mounted on the composite plate (2); wherein the composite plate (2) comprises a fiberglass plate (21) and a plastic plate (22) integrally connected to the fiberglass plate (21); the fiberglass plate (21) is engaged with the open side of the base (1) along an axial direction of the base (1); the plastic plate (22) is located on a surface facing the base (1) of the fiberglass plate (21);

wherein the inkjet head assembly comprises an electromagnetic valve connecting mechanism (3), a nozzle assembly (4), a charging slot (5), a deflection assembly (6) and a recovery mechanism (7), which are sequentially mounted on the composite plate (2);

the plastic plate (22) is arranged on a surface of one end of the fiberglass plate (21) corresponding to the nozzle assembly (4), the charging slot (5), the deflection assembly (6) and the recovery mechanism (7); the nozzle assembly (4), the charging slot (5), the deflection assembly (6) and the recovery mechanism (7) are locked on the plastic plate (22) with a locking assembly extending through the fiberglass plate (21);

wherein the electromagnetic valve connecting mechanism (3) comprises: at least one electromagnetic valve (31) disposed on a surface facing away from the base (1) of the fiberglass plate (21), and at least one heating member (32) disposed on a surface facing the base (1) of the fiberglass plate (21); wherein the electromagnetic valve (31) is provided with a pin (33) extending towards the fiberglass plate (21); a socket (34) is embedded in the fiberglass plate (21) and the heating member (32), the pin (33) is inserted into the socket (34) and is electrically connected to the socket (34).

2. The inkjet head device according to claim 1, wherein the electromagnetic valve connecting mechanism (3) further comprises a fastening assembly (35) disposed between the electromagnetic valve (31) and the heating member (32).

3. The inkjet head device according to claim 1, wherein a flowing passage (36) is arranged on the heating member (32) for liquid to pass through; the flowing passage (36) is communicated with the electromagnetic valve (31).

4. The inkjet head device according to claim 3, wherein the electromagnetic valve connecting mechanism (3) comprises four electromagnetic valves (31), which are an ink supply valve (31*a*), a cleaning valve (31*b*), a backflow valve (31*c*) and a recovery valve (31*d*) respectively;

the flowing passage (36) comprises an ink supply passage (36*a*) communicated with the ink supply valve (31*a*), a cleaning passage (36*b*) communicated with the cleaning valve (31*b*), and a backflow passage (36*c*) communicated with the backflow valve (31*c*); wherein the cleaning passage (36*b*), the cleaning valve (31*b*), the backflow valve (31*c*) and the backflow passage (36*c*) are communicated in sequence to form a cleaning circuit.

5. The inkjet head device according to claim 4, wherein one end of the heating member (32) is provided with three first inlets/outlets communicated with the ink supply passage (36*a*), the cleaning passage (36*b*) and the backflow passage (36*c*) respectively; another end of the heating member (32) is provided with two second inlets/outlets, wherein the ink supply valve (31*a*) and the cleaning valve (31*b*) are communicated with one second inlet/outlet, the backflow valve (31*c*) is communicated with another second inlet/outlet.

6. The inkjet head device according to claim 5, wherein the electromagnetic valve connecting mechanism (3) further comprises a first connecting base (37) and a second connecting base (38), which protrude out of the surface facing away from the base (1) of the fiberglass plate (21);

wherein the first connecting base (37) corresponds to the first inlet/outlet and is arranged on one end of the heating member (32), the first connecting base (37) is provided with three spaced first interfaces which are connected with the three first inlets/outlets respectively;

the second connecting base (38) corresponds to the second inlet/outlet and is arranged on another end of the heating member (32), the second connecting base (38) is provided with two spaced second interfaces which are connected with the two second inlets/outlets respectively.

7. The inkjet head device according to claim 4, wherein a recovery pipe (39) is arranged on a side facing the base (1) of the composite plate (2), the recovery pipe (39) is connected to the recovery mechanism (7) and the recovery valve (31*d*).

8. The inkjet head device according to claim 1, wherein the nozzle assembly (4) comprises an adjusting bracket (41), a nozzle (42) fixed on the adjusting bracket (41), and an eccentric adjusting assembly (43) arranged between the adjusting bracket (41) and the fiberglass plate (21) to drive the adjusting bracket (41) to horizontally swing on the fiberglass plate (21);

the eccentric adjusting assembly (43) comprises an eccentric member (431), a waist-shaped slot (432) which corresponds to the eccentric member (431) and is arranged on the fiberglass plate (21), and an adjusting center pillar member (433); wherein a lower end of the eccentric member (431) is arranged within the waist-shaped slot (432), an upper end of the eccentric member (431) extends through the adjusting bracket (41); the adjusting center pillar member (433) is positioned on one side of the eccentric member (431), a non-cylindrical pillar part of the adjusting center pillar member (433) is engaged with the fiberglass plate (21), a cylindrical top of the adjusting center pillar member (433) extends through the adjusting bracket (41).

9. The inkjet head device according to claim 8, wherein the adjusting bracket (41) comprises a substrate (411), and a supporting part (412) protruding out of the substrate (411); wherein the nozzle (42) is fixed on the supporting part (412) and is in parallel with the substrate (411); a first through hole (111) and a second through hole (112) are arranged on one side of the substrate (411), wherein the upper end of the eccentric member (431) is inserted within the first through hole (111), the cylindrical top of the adjusting center pillar member (433) is inserted within the second through hole (112).

10. The inkjet head device according to claim 8, wherein the nozzle assembly (4) further comprises a vertical adjusting assembly (44) arranged between the adjusting bracket (41) and the fiberglass plate (21), to adjust the height of the adjusting bracket (41) on the fiberglass plate (21);

the vertical adjusting assembly (44) and the eccentric adjusting assembly (43) are arranged on the adjusting bracket (41) and are adjacent to two opposite sides of the adjusting bracket (41) respectively.

11. The inkjet head device according to claim 10, wherein the vertical adjusting assembly (44) comprises a set screw (441), and a screw hole arranged on the adjusting bracket (41); the set screw (441) is engaged into the screw hole, the bottom of the set screw (441) is abutted against the fiberglass plate (21).

12. The inkjet head device according to claim 8, wherein the nozzle assembly (4) further comprises a first fixing assembly (45) and a second fixing assembly (46), which are arranged on the adjusting bracket (41) and are adjacent to another two opposite sides of the adjusting bracket (41) respectively, so as to lock the adjusting bracket (41) on the fiberglass plate (21).

13. The inkjet head device according to claim 12, wherein the first fixing assembly (45) comprises a first screw (451), a first waist-shaped hole (452) which corresponds to the first screw (451) and is arranged on the adjusting bracket (41), and a first fixing hole (453) which is communicated with the first waist-shaped hole (452) and is arranged on the fiberglass plate (21); the first screw (451) extends through the first waist-shaped hole (452) to be screwed into the first fixing hole (453);

a length direction of the first waist-shaped hole (452) is parallel to a horizontal swing direction of the adjusting bracket (41).

14. The inkjet head device according to claim 12, wherein the second fixing assembly (46) comprises a second screw (461), a second waist-shaped hole (462) which corresponds to the second screw (461) and is arranged on the adjusting bracket (41), and a second fixing hole (463) which is communicated with the second waist-shaped hole (462) and is arranged on the fiberglass plate (21); the second screw (461) extends through the second waist-shaped hole (462) to be screwed into the second fixing hole (463).

15. The inkjet head device according to claim 1, wherein one end of the base (1) is provided with a chamber (11) which is connected with the delivery pipe of the inkjet printer, the electromagnetic valve connecting mechanism (3) is arranged on the composite plate (2) and is adjacent to the chamber (11).

* * * * *